US008348786B2

(12) United States Patent
Nakano

(10) Patent No.: US 8,348,786 B2
(45) Date of Patent: Jan. 8, 2013

(54) IRON-TYPE GOLF CLUB HEAD

(75) Inventor: Takashi Nakano, Kobe (JP)

(73) Assignee: SRI Sports Limited, Kobe (JP)

( * ) Notice: Subject to any disclaimer, the term of this patent is extended or adjusted under 35 U.S.C. 154(b) by 404 days.

(21) Appl. No.: 12/793,376

(22) Filed: Jun. 3, 2010

(65) Prior Publication Data

US 2010/0323816 A1 Dec. 23, 2010

(30) Foreign Application Priority Data

Jun. 23, 2009 (JP) ..... 2009-148957

(51) Int. Cl.
*A63B 53/04* (2006.01)

(52) U.S. Cl. ..... 473/342; 473/348; 473/349; 473/350

(58) Field of Classification Search ..... 473/324, 473/342, 347–350
See application file for complete search history.

(56) References Cited

U.S. PATENT DOCUMENTS

| | | | | | |
|---|---|---|---|---|---|
| 4,708,347 | A * | 11/1987 | Kobayashi | 473/338 |
| 4,728,105 | A * | 3/1988 | Kobayashi | 473/348 |
| 4,874,171 | A * | 10/1989 | Ezaki et al. | 473/290 |
| 4,883,275 | A * | 11/1989 | Boone | 473/334 |
| 4,992,236 | A * | 2/1991 | Shira | 419/28 |
| 5,004,242 | A * | 4/1991 | Iwanaga et al. | 473/347 |
| 5,062,638 | A * | 11/1991 | Shira | 473/350 |
| 5,226,659 | A * | 7/1993 | Lo | 473/348 |
| 5,447,311 | A * | 9/1995 | Viollaz et al. | 473/342 |
| 5,509,660 | A * | 4/1996 | Elmer | 473/288 |
| 5,669,825 | A * | 9/1997 | Shira | 473/324 |
| 5,938,543 | A * | 8/1999 | McGeeney et al. | 473/324 |
| 6,503,151 | B2 * | 1/2003 | Kosovac | 473/244 |
| 6,860,820 | B2 * | 3/2005 | Specht | 473/312 |
| 7,029,404 | B2 * | 4/2006 | Lu | 473/334 |
| 7,037,211 | B1 * | 5/2006 | Kosovac | 473/304 |
| 7,083,525 | B2 * | 8/2006 | Pond et al. | 473/251 |
| 7,144,336 | B2 * | 12/2006 | Reyes et al. | 473/342 |
| 8,012,040 | B2 * | 9/2011 | Takechi | 473/329 |
| 2004/0055696 | A1 * | 3/2004 | Reyes et al. | 156/242 |
| 2007/0281796 | A1 | 12/2007 | Gilbert et al. | |
| 2011/0230279 | A1 * | 9/2011 | Oldknow et al. | 473/350 |

FOREIGN PATENT DOCUMENTS

| | | | |
|---|---|---|---|
| JP | 10151231 A | * | 6/1998 |
| JP | 10-314349 A | | 12/1998 |

* cited by examiner

*Primary Examiner* — Stephen L. Blau
(74) *Attorney, Agent, or Firm* — Birch, Stewart, Kolasch & Birch, LLP

(57) ABSTRACT

An iron-type golf club head is assembled from a front component (4) made of a metal material having a specific gravity ρ1, a rear component (5) made of a fiber reinforced resin having a specific gravity ρ2 lower than the specific gravity ρ1, a toe-side component (6) made of a metal material having a specific gravity ρ3 higher than the specific gravity ρ1, and a heel-side component (7) made of a metal material having a specific gravity ρ4 higher than the specific gravity ρ1.

10 Claims, 6 Drawing Sheets

IRON-TYPE GOLF CLUB HEAD

BACKGROUND OF THE INVENTION

The present invention relates to an iron-type golf club head, more particularly to a hybrid golf club head assembled from components made of at least two kind of metal materials and a fiber reinforced resin.

Heretofore, in order to lower or adjust the position of the center of gravity and increase the moment of inertia of an iron-type golf club head, there have been widely employed a technique to insert a weight member in a lower part of the club head.

For example, in the Japanese published unexamined application No. 10-314349, as shown in FIG. 6(A), the sole (s) of the head (i) is provided with a hollow, and a weight member KO made of a tungsten alloy is placed in the hollow, and the opening of the hollow is closed by a metallic alloy plate.

In the US Patent application publication US 2007-281796-A1, as shown in FIG. 6(B), a plurality of weight members are inserted in the toe (t), heel (h) and sole (s) of the head.

In these techniques, in order to insert the weight members KO, their maximum sizes are limited, and thereby the increase in the moment of inertia and the lowering of the position of the center of gravity are limited.

Further, when making the weight members KO and forming the holes or hollows into which the weight members KO are inserted, high dimensional accuracy is required, therefore, the production efficiency is not good.

SUMMARY OF THE INVENTION

It is therefore, an object of the present invention to provide an iron-type golf club head, which has a hybrid structure of metal materials and fiber reinforced resin capable of increasing the lateral moment of inertia and decreasing or optimizing the position of the center of gravity, and thereby performance such as the directional stability and carry distance of the balls, ball controllability and the like can be improved.

According to the present invention, an iron-type golf club head comprises a main body and a hosel, wherein the main body comprises a front surface including an impact area for striking a ball, a back surface opposite to the front surface, and an outer circumferential surface extending between the front surface and the back surface and including a top surface, a toe surface and a sole surface, the hosel extends upwardly from the main body on its heel-side and has a shaft inserting hole into which an end of a club shaft is inserted, a major part of the front surface and a major part of the sole surface are formed by a metal material having a specific gravity $\rho 1$, a major part of the back surface and a major part of the top surface are formed by a fiber reinforced resin having a specific gravity $\rho 2$ lower than the specific gravity $\rho 1$, a lower part of the toe surface is formed by a metal material having a specific gravity $\rho 3$ higher than the specific gravity $\rho 1$, and the hosel is made of a metal material having a specific gravity $\rho 4$ higher than the specific gravity $\rho 1$.

Therefore, owing to the metal material having the specific gravity $\rho 1$ and fiber reinforced resin having the specific gravity $\rho 2$, it becomes possible to make the club head heavy on the sole-side and light on the upper side.

Further, owing to the metal material having the specific gravity $\rho 3$ and the metal material having the specific gravity $\rho 4$, it becomes possible to make the club head heavy on the toe-side and heel-side and light in the central portion therebetween. Accordingly, it is possible to increase the lateral moment of inertia and to lower the position of the center of gravity, and thereby the directionality of the hit ball can be improved. Further, it becomes easy to strike a ball at a high launching angle.

DESCRIPTION OF THE PREFERRED EMBODIMENTS

Figure 1:
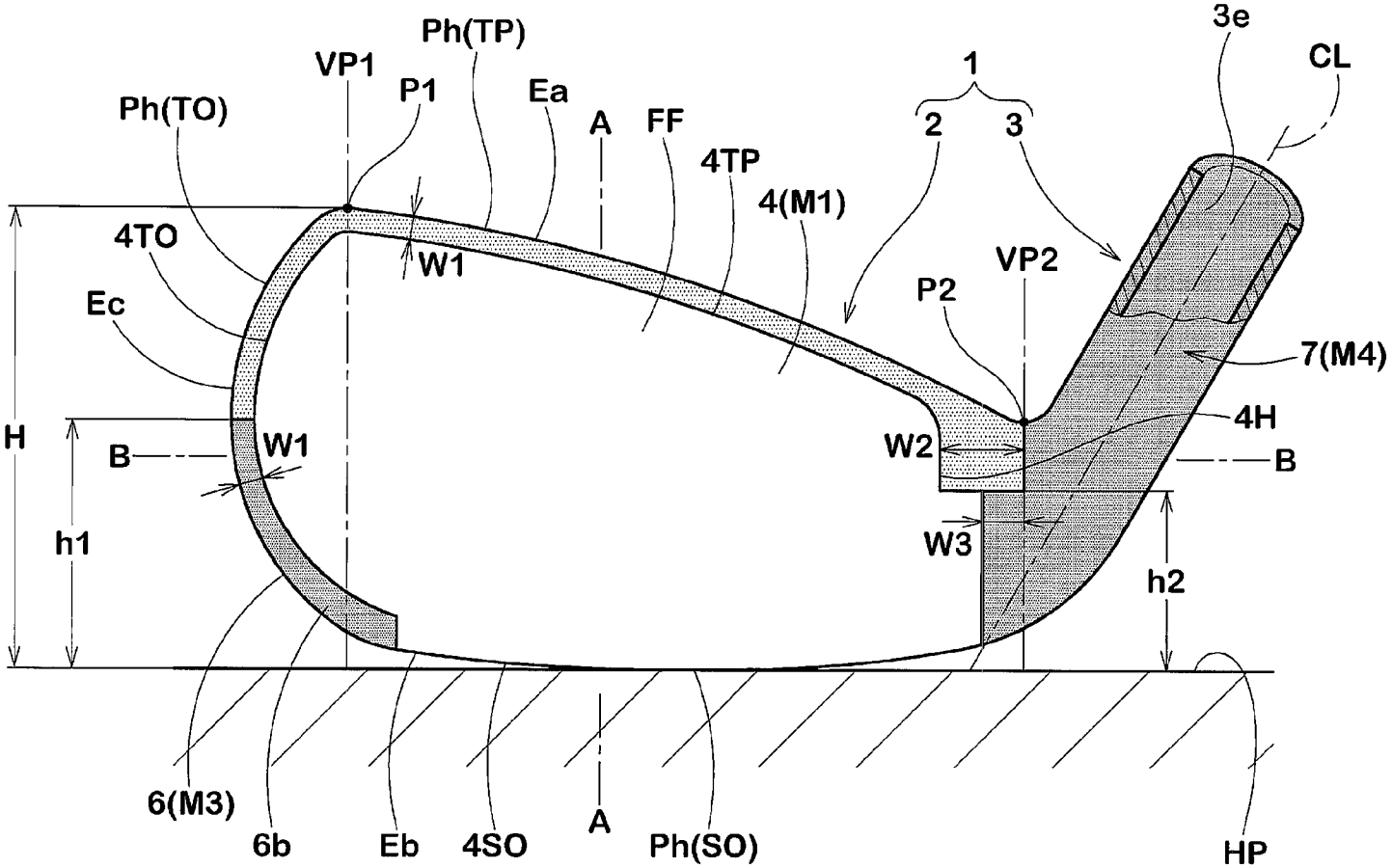
FIG. 1 is a front view of an iron-type golf club head according to the present invention.

Embodiments of present invention will now be described in detail in conjunction with accompanying drawings.

In the drawings, an iron-type golf club head 1 according to the present invention comprises a main body 2 and a hosel 3.

The hosel 3 comprises a tubular main part extending upward from the heel-side of the main body 2 and having a shaft inserting hole 3*e* into which a club shaft (not shown) is inserted.

The main body 2 has a front surface FF including an impact area for striking a ball, a back surface FB opposite to the front surface FF, and an outer circumferential surface Ph between the front surface FF and the back surface FB.

In this embodiment, the lie angle can be in a range of from 50 to 70 degrees, and the loft angle can be in a range of from 15 to 70 degrees.

The mass of the club head 1 is set in a range of not less than 200 g, preferably not less than 220 g, more preferably not less than 230 g, but not more than 300 g, preferably not more than 290 g, more preferably not more than 280 g.

If the mass is less than 200 g, there is a tendency that the flexibility of designing the mass distribution decreases. If more than 300 g, it becomes difficult swing the golf club.

The above-mentioned front surface FF is substantially flat, excepting impact area markings (not shown) such as grooves and punch marks.

Figure 2:
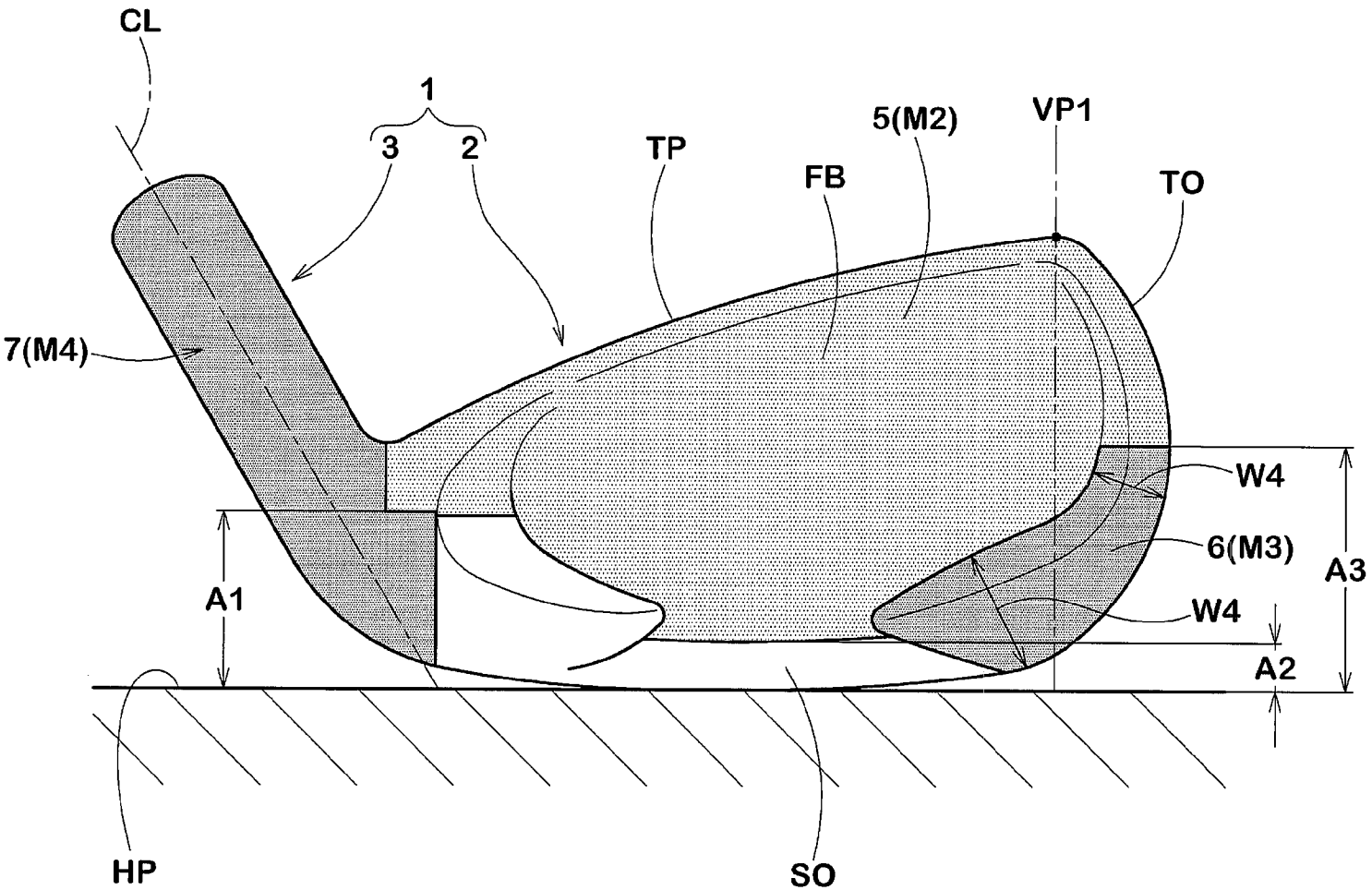
FIG. 2 is a rear view of the head.
Figure 3:
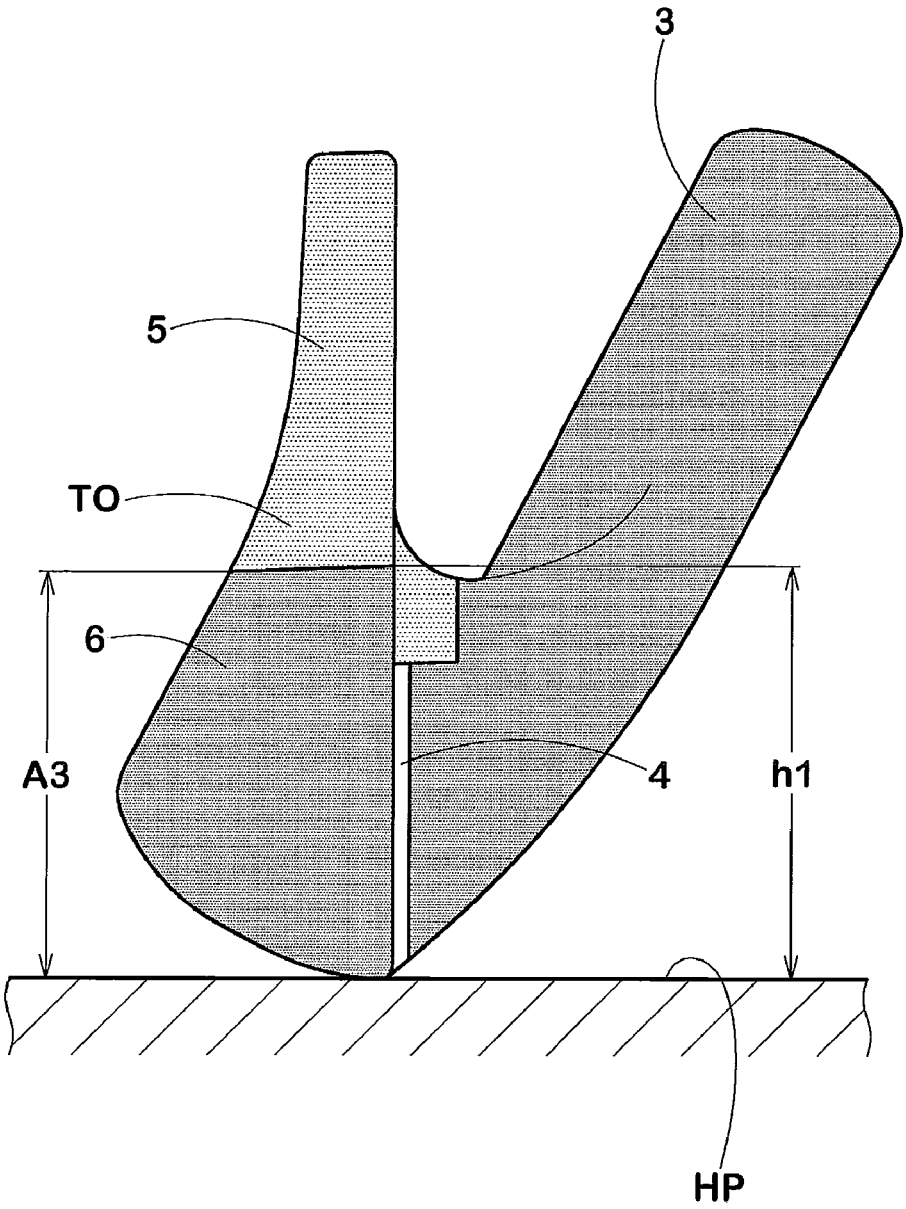
FIG. 3 is a left side view of the head.

FIGS. 1 to 3 show the club head 1 under a measuring state.

The measuring state is different from its normal state.

The normal state is such that the club head is set on a horizontal plane HP so that the axis of the club shaft is inclined at the lie angle while keeping the axis on a vertical plane, and the club face forms its loft angle with respect to the horizontal plane HP. Incidentally, in the case of the club head alone, the center line of the shaft inserting hole can be used instead of the axis of the club shaft.

The measuring state is such that the club head is first set in the above-mentioned normal state, and then the above-mentioned vertical plane is inclined forwardly by the loft angle, while keeping the club head in contact with the horizontal plane HP, so that the club face becomes vertical or perpendicular to the horizontal plane HP.

In this application including the description and claims, sizes, positions, directions and the like relating to the club head refer to those under the measuring state unless otherwise noted.

The "lateral moment of inertia" or shortly "moment of inertia" is a moment of inertia around an axis passing through the center of gravity of the head perpendicularly to the horizontal plane HP in the normal state.

"Sweet spot" is the intersecting point between the front surface FF and a straight line drawn from the center of gravity of the head to the front surface FF perpendicularly thereto.

"Sweet spot height" is the distance between the sweet spot and the horizontal plane HP measured perpendicularly to the horizontal plane HP.

In the measuring state, as shown in FIG. 1, the upper edge of the front surface FF has a highest point P1 on the toe-side (hereinafter, the "highest toe-side point P1") and a lowest point P2 on the heel-side (hereinafter, the "lowest heel-side point P2").

Using these points, a vertical plane being perpendicular to the front surface FF and including the toe-side point P1 (hereinafter, the "toe-side vertical plane VP1") is defined. Further, a vertical plane being perpendicular to the front surface FF and including the heel-side point P2 (hereinafter, the "heel-side vertical plane VP2") is defined.

The above-mentioned outer circumferential surface Ph includes: an upper surface TP extending between the toe-side vertical plane VP1 and heel-side vertical plane VP2; a lower surface so extending between the toe-side vertical plane VP1 and heel-side vertical plane VP2; and a toe surface TO extending on the toe-side of the toe-side vertical plane VP1 between the upper surface TP and lower surface SO.

The upper surface TP extends almost straight while inclining downwardly towards the heel from the toe.

The lower surface SO slightly and convexly curves so as to swell downwards.

The toe surface TO convexly curves so as to swell toward the heel-side.

According to the present invention:

a major part of the front surface FF and a major part of the lower surface SO are formed by a metal material M1 having a specific gravity $\rho 1$;

a major part of the back surface FB and a major part of the upper surface TP are formed by a fiber reinforced resin M2 having a specific gravity $\rho 2$ less than the specific gravity $\rho 1$;

a lower part of the toe surface TO is formed by a metal material M3 having a specific gravity $\rho 3$ more than the specific gravity $\rho 1$; and the hosel 3 is made of a metal material M4 having a specific gravity $\rho 4$ more than the specific gravity $\rho 1$.

Figure 5:
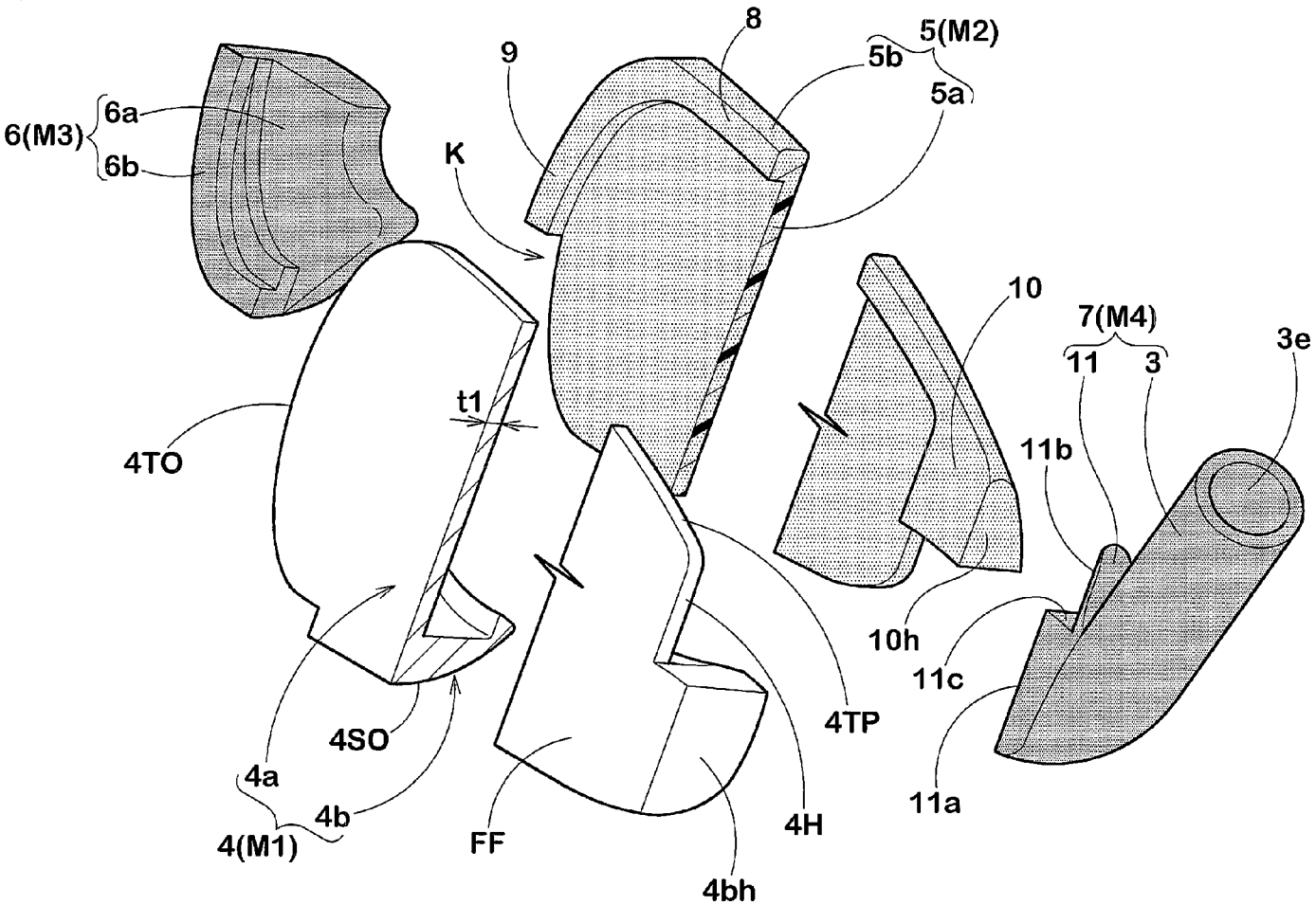
FIG. 5 is an exploded perspective view of the head.
Figure 6A:
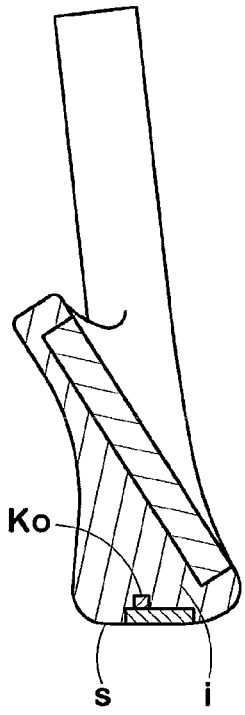
FIG. 6(A) is a cross-sectional view of a prior art golf club head.
Figure 6B:
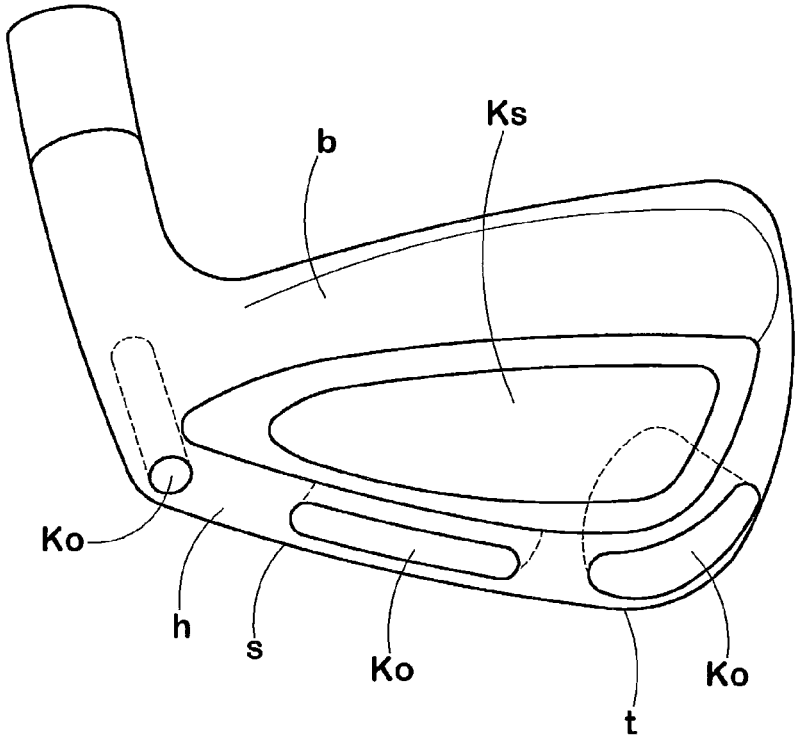
FIG. 6(B) is a rear view of a prior art golf club head.

In order to achieve this arrangement, as best shown in FIG. 5, the club head 1 is assembled from a front component 4 made of the metal material M1, a rear component 5 made of the fiber reinforced resin M2, a toe-side component 6 made of the metal material M3, and a heel-side component 7 made of the metal material M4.

In this embodiment, the toe-side component 6 and heel-side component 7 are made of the identical metal material (namely, M3=M4, and $\rho 3=\rho 4$).

As best shown in FIG. 4 and FIG. 5, the front component 4 integrally includes a thin main plate 4*a* and a thick sole plate 4*b*.

The main plate 4*a* is defined as having a substantially constant thickness t1, and forms a major part of the front surface FF. The major part of the front surface FF means a part having at least 60%, preferably at least 70%, more preferably at least 75% of the total area of the front surface FF. The main plate 4*a* has a contour shape similar to that of the front surface FF so as to extend almost allover the width of the front surface FF in the toe-heel direction, and almost allover the height of the front surface FF in the top-sole direction.

The upper edge 4TP and the toe-side edge 4TO of the main plate 4*a* are positioned within the front surface FF at a distance W1 from the upper edge Ea and the toe-side edge EC of the front surface FF toward the center of the main body 2.

The lower edge 4SO of the main plate 4*a* is positioned at the lower edge Eb of the front surface FF.

The heel-side edge 4H of the main plate 4*a* is positioned within the front surface FF at a distance W2 from the heel-side vertical plane VP2 toward the toe-side.

The thick sole plate 4*b* extends backwardly of the head from the lower end of the main plate 4*a* so as to form a major part of the above-mentioned lower surface SO.

The major part of the lower surface SO means a part having an area of at least 60%. preferably at least 70%, more preferably at least 75% of the total area of the lower surface SO.

The sole plate 4*b* has a thickness more than that of the main plate 4*a* in order to distribute a large mass to the sole.

As shown in FIGS. 1 and 5, the sole plate 4*b* protrudes from the heel-side edge 4H of the main plate 4*a* towards the heel-side.

In the front view, the heel-side end 4*bh* of the sole plate 4*b* is positioned at a distance W3 from the heel-side vertical plane VP2 towards the toe-side.

The distance W3 is smaller than the above-mentioned distance W2. (W3<W2) Therefore, in the front view, the heel-side edge of the front component 4 has a stepwise configuration.

The heel-side end 4*bh* in this embodiment is defined by a surface parallel with the heel-side vertical plane VP2.

Such stepwise configuration increases the bonding area with the heel-side component and the bonding strength is increased.

Figure 4A:
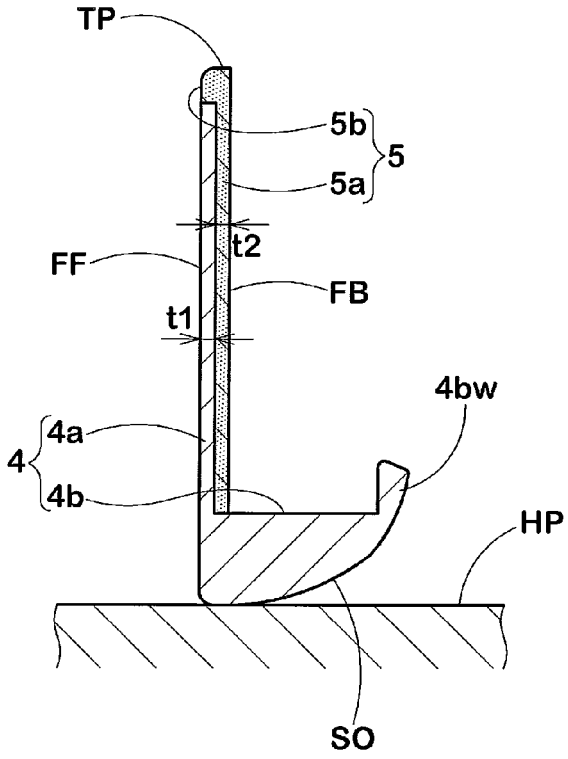
FIG. 4(A) shows a cross section of the head taken along line A-A in FIG. 1.

Further, the sole plate 4*b* is, as shown in FIG. 4(A), provided at the rear end part thereof with a rising part 4*bw* rising upwards by a small height in order to deepen the center of gravity by distributing the mass to the backward.

The rear component 5 integrally includes a thin backside plate 5*a* and a flange 5*b* as shown in FIG. 5.

The backside plate 5*a* is defined as having a substantially constant thickness t2 and fixed to the back surface of the main plate 4*a* of the front component 4 so as to cover the entirety of the back surface of the main plate 4*a*. The backside plate 5*a* can reinforce the thin main plate 4*a* and reduce unnecessary vibrations to improve impact feelings.

The flange 5*b* is formed at the edge of the backside plate 5*a* and protrudes forward from the front surface of the backside plate 5*a*.

The flange 5*b* includes a top-side flange 8, an upper toe-side flange 9 and an upper heel-side flange 10, and as shown in FIG. 1 and FIG. 5, no flange is formed on the sole-side of the backside plate 5*a* from the lower end of the upper toe-side flange 9 to the lower end of the upper heel-side flange 10.

The top-side flange 8 covers a major part (in this embodiment, the entirety) of the upper end surface of the main plate 4*a* of the front component 4, and forms an upper edge portion of the front surface FF and the entirety of the upper surface TP.

The upper toe-side flange 9 covers an upper part of the toe-side end surface the main plate 4*a*, and forms an upper part (in this embodiment, about one half) of the toe surface TO and an upper part of the toe-side edge portion of the front surface FF.

The upper heel-side flange 10 covers the heel-side end surface of the main plate 4*a* of the front component 4, and forms an upper part of the heel-side edge portion of the front surface FF.

As shown in FIG. 1, the upper heel-side flange 10 extends towards the heel-side beyond the above-mentioned heel-side end 4*bh* of the sole plate 4*b* of the front component 4 so that its heel-side end 10*h* is positioned on the heel-side of the heel-side end 4*bh*.

The heel-side end 10*h* in this embodiment is defined by a surface parallel with the heel-side vertical plane VP2.

Therefore, a stepped surface is formed by the front component 4 and the rear component 5 on their heel-side.

The toe-side component 6 integrally includes a main part 6*a* and a lower toe-side flange 6*b*.

The main part 6*a* is disposed in a lower position on the toe-side of the rear component 5 and on the back side of the rear component 5.

Figure 4B:
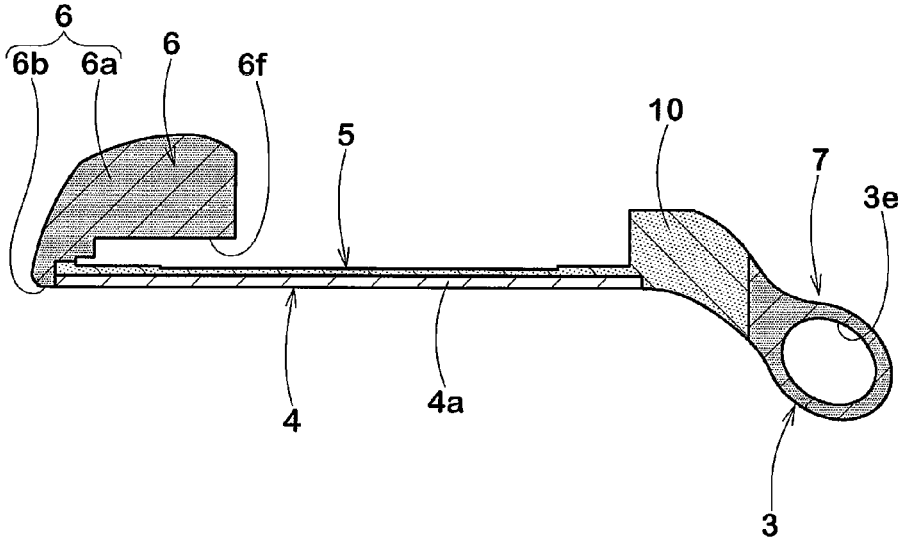
FIG. 4(B) shows a cross section of the head taken along line B-B in FIG. 1.

As shown in FIG. 4(B), the front surface 6*f* of the main part 6*a* is spaced apart from the back surface of the rear component 5, forming a gap therebetween. Accordingly, the mass is further shifted backward.

The lower toe-side flange 6*b* protrudes forward from the main part 6*a* on the toe-side of the main part 6*a* and is disposed in a lower part on the toe-side of the front component 4.

The lower toe-side flange 6*b* covers a lower part of the toe-side end surface of the front component 4 and forms a lower part (in this embodiment, about one half) of the surface TO and a lower part of the toe-side edge portion of the front surface FF.

As shown in FIG. 2, in the rear view of the club head under the measuring state, at least on the toe-side of the toe-side vertical plane VP1, the width W4 of the toe-side component 6 is gradually increased from the top-side toward the sole-side. Here, the width W4 is measured from the outer circumferential edge of the main body 2 perpendicularly thereto.

Therefore, it is possible to design a more effective mass distribution which helps to lower the center of gravity and increase the moment of inertia.

In this embodiment, on the heel-side of the toe-side vertical plane VP1, the width W4 is gradually decreased toward the heel-side, and the toe-side component 6 terminates at a position which is about ⅓ of the distance in the toe-heel direction between the heel-side vertical plane VP2 and the toe-side vertical plane VP1, from the toe-side vertical plane VP1.

The heel-side component 7 integrally includes the above-mentioned tubular hosel 3 and an attaching portion 11.

The attaching portion 11 has a stepped surface adapted to the above-mentioned stepped surface formed by the front component 4 and the rear component 5 on their heel-side. The stepped surface comprises:

a lower vertical surface 11*a* which abuts on and is bonded to the surface of the heel-side end 4*bh* of the front component 4;

an upper vertical surface 11*b* which abuts on and is bonded to the surface of the heel-side end 10*h* of the rear component 5; and an in-between surface 11*c* with which the upper vertical surface 11*b* and the lower vertical surface 11*a* are connected and which abuts on and is bonded to the heel-side downward surface of the upper heel-side flange 10 of the rear component 5.

In this embodiment, the in-between surface 11*c* and the heel-side downward surface are substantially parallel with the horizontal plane HP in the measuring state.

In the attaching portion 11, a lower part defining the lower vertical surface 11*a* extends toward the toe-side more than an upper part defining the upper vertical surface 11*b*, therefore, it is possible to distribute a mass to a lower part on the heel-side.

The above-mentioned specific gravity ρ1 is set in a range of from not less than 1.8, preferably not less than 2.0, more preferably not less than 4.0, but not more than 10.0, preferably not more than 9.0, more preferably not more than 8.0. If the specific gravity ρ1 is more than 10.0, the mass of the club head increases, and it becomes difficult to design an effective mass distribution. If the specific gravity ρ1 is less than 1.8, the strength of the metal material is liable to become insufficient.

As to the metal material M1 of the front component 4 having the specific gravity ρ1, stainless steels, maraging steels, pure titanium, titanium alloys, aluminum alloys, magnesium alloys or the like, or amorphous alloys may be used. Especially, metal materials whose specific strength is high, for example, titanium alloys are preferably used.

Thus, it is possible to improve the durability of the front surface FF which directly contacts with the ball, and the durability of the lower surface so which is liable to contact with the ground during golf swing.

The specific gravity ρ2 of the fiber reinforced resin M2 is set in a range of from not less than 1.0, preferably not less than 1.2, more preferably not less than 1.5, but not more than 3.0, preferably not more than 2.5, more preferably not more than 2.0.

If the specific gravity ρ2 is less than 1.0, the strength decreases and becomes insufficient. If the specific gravity ρ2 is more than 3.0, it becomes difficult to get a sufficient mass margin.

As to the reinforcing fibers of the fiber reinforced resin M2, for example, carbon fibers, graphite fibers, glass fibers, alumina fibers, boron fibers, aromatic polyester fibers, aramid fibers, PBO fibers, amorphous metal fibers, titanium fibers, and the like can be used.

Especially, carbon fibers are preferable because of the low specific gravity and high tensile strength.

As to the matrix resin of the fiber reinforced resin M2, for example, thermosetting resins such as epoxide resin, phenol resin, polyester resin, and unsaturated polyester resin, and thermoplastic resins such as polycarbonate resin and nylon resin can be used.

Especially, epoxide resins are preferable in view of the cost and general versatility.

The specific gravity ρ3, ρ4 of the metal material M3, M4 is preferably set in a range of from not less than 7.0, more preferably not less than 7.5, still more preferably not less than 8.0, but not more than 18.0, more preferably not more than 17.0, still more preferably not more than 16.0.

If the specific gravity ρ3, ρ4 is less than 7.0, it is difficult to obtain a large lateral moment of inertia. If the specific gravity ρ3, ρ4 is more than 18.0, the mass of the club head tends to excessively increase.

As to the metal material M3, M4 having the specific gravity ρ3, ρ4, for example, tungsten, tungsten alloys (W—Ni, W—Cu), copper, brass, and stainless steels can be used. Especially, W—Ni tungsten alloys are preferred in view of the specific gravity and cost.

Preferably, the specific gravity ratio ρ2/ρ1 is not less than 0.1, more preferably not less than 0.2, still more preferably not less than 0.3, but less than 1.0;

the specific gravity ratio ρ1/ρ3 is not less than 0.1, more preferably not less than 0.2, still more preferably not less than 0.3, but less than 1.0; and the specific gravity ratio ρ1/ρ4 is not less than 0.1, more preferably not less than 0.2, still more preferably not less than 0.3, but less than 1.0.

If the specific gravity ratios ρ2/ρ1, ρ1/ρ3, ρ1/ρ43 are less than 0.1, there is a tendency that the position of the center of gravity becomes very low, and further it is difficult to obtain a large lateral moment of inertia. If the specific gravity ratios ρ1/ρ3 and ρ1/ρ4 are less than 0.1, there is a tendency that the mass of the hosel 3 is increased, and the height of the center of gravity is increased.

The above-mentioned thickness t1 of the thin main plate 4*a* of the front component 4 is preferably set in a range of from not less than 1.0 mm, more preferably not less than 1.1 mm, still more preferably not less than 1.2 mm, but not more than 3.0 mm, more preferably not more than 2.9 mm, still more preferably not more than 2.8 mm.

If the thickness t1 is less than 1.0 mm, it is difficult to provide a sufficient strength and durability for the club face. If the thickness t1 is more than 3.0 mm, the coefficient of restitution is decreased, and the carry distance tends to decrease.

The thickness t2 of the thin backside plate 5*a* of the rear component 5 is preferably set in a range of from not less than 1.0 mm, more preferably not less than 1.1 mm, still more preferably not less than 1.2 mm, but not more than 3.0 mm, more preferably not more than 2.9 mm, still more preferably not more than 2.8 mm.

If the thickness t2 is less than 1.0 mm, it is difficult to effectively reinforce the thin main plate 4*a*. If the thickness t2 is more than 3.0 mm, the coefficient of restitution is decreased, and the carry distance tends to decrease.

The distance W1 of the upper edge 4TP and toe-side edge 4TO of the main plate 4*a* from the upper edge Ea and toe-side edge Ec of the front surface FF, and the distance W2 between the heel-side edge 4H of the main plate 4*a* and the heel-side vertical plane VP2 are set in a range of not less than 1 mm, preferably not less than 3 mm, more preferably not less than 5 mm, but not more than 20 mm, preferably not more than 15 mm, more preferably not more than 10 mm.

Since the top-side flange 8, upper toe-side flange 9 and upper heel-side flange 10 are lower in the specific gravity than the main plate 4*a*, a mass margin can be obtained corresponding to the difference (ρ1−ρ2) in the specific gravity therebetween and the volume of the flanges 8-10, and the freedom of designing the mass distribution is increased.

In the front view of the club head under the measuring state, when the maximum height H of the main body 2, the lowest height h1 of the rear component 5 appearing on the toe-side, and the lowest height h2 of the rear component 5 appearing on the heel-side are defined as shown in FIG. 1:

the ratio (h1/H) is set in a range of not less than 0.2, preferably not less than 0.3, more preferably not less than 0.4, but not more than 0.8, preferably not more than 0.7, more preferably not more than 0.6; and the ratio (h2/H) is set in a range of not less than 0.20, preferably not less than 0.25, more preferably not less than 0.30, but not more than 0.60, preferably not more than 0.55, more preferably not more than 0.50.

Thereby, it is possible to effectively increase the lateral moment of inertia and lower the position of the center of gravity of the head. Further, it is possible to facilitate to work out a mass margin to increase the freedman of the mass distribution design.

If the ratio (h1/H) decreases under the lower limit, it becomes difficult to effectively increase the lateral moment of inertia. If the ratio (h1/H) increases over the upper limit, it becomes difficult to lower the position of the center of gravity of the head.

If the ratio (h2/H) decreases under the lower limit, it becomes difficult to effectively increase the lateral moment of inertia. If the ratio (h2/H) increases over the upper limit, it becomes difficult to lower the position of the center of gravity of the head.

Preferably, the height h1 is set in a range of not less than 10 mm, more preferably not less than 15 mm, still more preferably not less than 20 mm, but not more than 35 mm, more preferably not more than 30 mm, still more preferably not more than 25 mm.

If the height h1 is less than 10 mm, the toe-side component 6 becomes small, and as a result, it becomes difficult to increase the lateral moment of inertia and lower the center of gravity. If the height h1 is more than 35 mm, the center of gravity becomes high, and the mass of the club head 1 increases, and as a result, it becomes difficult to swing the golf club.

Preferably, the maximum height H is set in a range of not less than 40 mm, more preferably not less than 45 mm, still more preferably not less than 50 mm, but not more than 80 mm, more preferably not more than 75 mm, still more preferably not more than 70 mm.

If the maximum height H is less than 40 mm, there is a tendency that the golf club head at address gives the user uncomfortable impression, and as a result, it becomes difficult to swing the golf club. If the maximum height H is more than 80 mm, the center of gravity is liable to become high.

In the rear view of the club head 1 under the measuring state, when the lowest height A1 of the rear component 5 appearing on the heel-side, the lowest height A3 of the rear component 5 appearing on the toe-side, and the lowest height A2 of the rear component 5 appearing in the central portion of the back surface FB are defined as shown in FIG. 2, the height A1 is more than the height A2 and the height A3 is more than the height A2. (A1>A2<A3)

Thereby, the lateral moment of inertia can be increased.

In order to make the position of the center of gravity of the head lower, while increasing the lateral moment of inertia:

the height A1 is preferably set in a range of not less than 11 mm, more preferably not less than 12 mm, still more preferably not less than 13 mm, but not more than 20 mm, more preferably not more than 19 mm, still more preferably not more than 18 mm;

the height A2 is preferably set in a range of not less than 1 mm, more preferably not less than 2 mm, still more preferably not less than 3 mm, but not more than 10 mm, more preferably not more than 9 mm, still more preferably not more than 8 mm; and the height A3 is preferably set in a range of not less than 21 mm, more preferably not less than 22 mm, still more preferably not less than 23 mm, but not more than 30 mm, more preferably not more than 29 mm, still more preferably not more than 28 mm.

In order to reduce the mass of the central portion of the club face and to obtain a mass margin therefrom, the ratio (A2/H) of the height A2 to the maximum height H of the main body 2 is preferably set in a range of not less than 0.02, more preferably not less than 0.05, still more preferably not less than 0.1, but not more than 0.4, more preferably not more than 0.3, still more preferably not more than 0.25.

In order to distribute a mass to a toe-side part of the main body 2 as much as possible, and to increase the lateral moment of inertia, the ratio (A3/H) of the height A3 to the maximum height H of the main body 2 is preferably set in a range of not less than 0.2, more preferably not less than 0.3, still more preferably not less than 0.4, but not more than 0.8, more preferably not more than 0.7, still more preferably not more than 0.6.

The front component 4 can be formed by forging, casting, sintering or the like.

The rear component 5 can be formed by integral molding, for example, a prepreg method, a filament winding method, a resin transfer molding and the like.

The toe-side component 6 and the heel-side component 7 can be formed by casting, sintering, machining and the like.

The front component 4, rear component 5, toe-side component 6 and heel-side component 7 are assembled into the club head 1. When assembled, the front surface of the main plate 4*a*, the front surface of the flange 5*b* and the front surface of the lower toe-side flange 6*b* become substantially flat and forms the front surface FF.

In order to fix the front component 4 to the toe-side component 6 and the heel-side component 7, for example, welding, soldering, adhesive bonding, frictional jointing, explosion bonding, press fitting, and/or screw/bolt may be used. In this embodiment, however, an adhesive agent is used.

In order to fix the front component 4 to the rear component 5, for example, adhesive bonding, and/or screw/bolt may be used. In this embodiment, however, in view of production efficiency, an adhesive agent is preferably used.

Owing to the above-mentioned stepped surface of the attaching portion 11 and the stepped surface formed by the front component 4 and rear component 5 on their heel-side, even when an adhesive agent is used, a high bonding strength can be obtained.

Further, since the components 4-7 are connected to each other by abutting their surfaces which are mainly flat surfaces, in other words, it is not necessary to make holes or hollows and make the components having the shapes adapted to those of the holes as in the prior arts, the production efficiency can be improved in comparison with the prior arts.

Whereas, the club head 1 may be provided with a weight member having a specific gravity higher than ρ3 and ρ4, a vibration damper made of an elastic material, and/or a decorative badge.

Comparison Test

Based on the structure as shown in FIGS. 1-4, iron-type golf club heads for #5 iron (club head mass 250 g, lie angle 61 degrees, loft angle 24 degrees) were made and tested.

All of the heads had the same structures and specifications except for the specifications shown in Table 1. Specifications common to all of the heads are as follows:

Material M1: titanium alloy (Ti-6Al-4V)
Specific gravity ρ1: 4.4
Thickness t1 of main part: 1.3 mm
Material M2: carbon fiber reinforced resin (CFRP)
Specific gravity ρ2: 1.8
Thickness t2 of backside wall: 1.3 mm
Material M3: tungsten-nickel alloy
Material M4: tungsten-nickel alloy
Specific gravity ρ3=ρ4: 15
Fixing Method
Front and Rear components: adhesive agent
Front and Heel-side components: adhesive agent
Front and Toe-side components: adhesive agent
Rear and Heel-side components: adhesive agent
Rear and Toe-side components: adhesive agent In the comparison test, the club heads were attracted to identical FRP shafts ("MP-300" Flex R, manufactured by SRI Sports Ltd.) to make 38-inch #5 iron clubs.

Using each of the iron clubs, five golfers having handicap ranging from 5 to 15 struck three-piece golf balls ("XXIO" manufactured by SRI Sports Ltd.) five times for each person. And the directional stability of the balls and whether easy to rise the balls were evaluated into five ranks. The mean values are shown in Table 1, wherein the larger rank number is better.

TABLE 1

| Club Head | Ref. 1 | Ex. 1 | Ex. 2 | Ex. 3 | Ex. 4 | Ex. 5 |
|---|---|---|---|---|---|---|
| Height | | | | | | |
| H (mm) | 55 | 55 | 55 | 55 | 55 | 55 |
| h1 (mm) | — | 27.5 | 22 | 33 | 11 | 44 |
| h2 (mm) | — | 22 | 16.5 | 27.5 | 11 | 33 |
| A1 (mm) | — | 22 | 16.5 | 27.5 | 11 | 33 |
| A2 (mm) | — | 10 | 10 | 10 | 10 | 10 |
| A3 (mm) | — | 27.5 | 22 | 33 | 11 | 44 |
| h1/H | — | 0.5 | 0.4 | 0.6 | 0.2 | 0.8 |
| h2/H | — | 0.4 | 0.3 | 0.5 | 0.2 | 0.6 |
| A2/H | — | 0.18 | 0.18 | 0.18 | 0.18 | 0.18 |
| A3/H | — | 0.5 | 0.4 | 0.6 | 0.2 | 0.8 |
| Moment of inertia (g sq.cm) | 2000 | 3700 | 3500 | 3800 | 3000 | 3850 |
| Sweet spot height (mm) | 21 | 20 | 19.5 | 21 | 19 | 23 |
| Directional stability | 1 | 5 | 4 | 5 | 3 | 5 |
| Whether easy to rise | 4 | 5 | 5 | 4 | 5 | 3 |

Ref. 1: The entirety of the head was made of Ti-6Al-4V.

REFERENCE SIGNS LIST

1 iron-type golf club head
2 main body
3 hosel
3*e* shaft inserting hole
4 front component
5 rear component
6 toe-side component
7 heel-side component
FF front surface
FB back surface
TP top surface
TO toe surface
SO sole surface
Ph outer circumferential surface

The invention claimed is:

1. An iron-type golf club head comprising a main body (2) having a front surface (FF) including an impact area for striking a ball, a back surface (FB) opposite to the front surface, and an outer circumferential surface (Ph) extending between the front surface and the back surface and including a top surface (TP), a toe surface (TO) and a sole surface (SO), and a hosel (3) protruding upwardly from the main body on the heel-side of the main body and having a shaft inserting hole (3*e*) into which an end of a club shaft is inserted, wherein a major part of the front surface (FF) and a major part of the sole surface (FB) are formed by a metal material having a specific gravity ρ1, a major part of the back surface (FB) and a major part of the top surface (TP) are formed by a fiber reinforced resin having a specific gravity ρ2 lower than the specific gravity ρ1, a lower part of the toe surface (TO) is formed by a metal material having a specific gravity ρ3 higher than the specific gravity ρ1, and the hosel (3) is made of a metal material having a specific gravity ρ4 higher than the specific gravity ρ1.

2. The iron-type golf club head according to claim 1, which comprises:

a front component (4) made of said metal material having the specific gravity ρ1, a rear component (5) made of said fiber reinforced resin having the specific gravity ρ2, and a toe-side component (6) made of said metal material having the specific gravity ρ3.

3. The iron-type golf club head according to claim 2, which further comprises:

a heel-side component (7) made of said metal material having the specific gravity ρ4.

4. The iron-type golf club head according to claim 2, wherein the front component (4) has an upper edge (4TP) positioned within the front surface (FF), and the rear component (5) comprises a backside plate (5*a*) extending along a back surface of the front component (4), and a top-side flange (8) protruding forward from the backside plate (5*a*) so as to form the top surface (TP) and an upper edge portion of the front surface (FF) above said upper edge (4TP).

5. The iron-type golf club head according to claim 2, wherein the front component (4) has a toe-side edge (4TO) positioned within the front surface (FF), and the rear component (5) comprises a backside plate (5*a*) extending along a back surface of the front component (4), and an upper toe-side flange (9) protruding forward from the backside plate (5*a*) so as to form an upper part of said toe surface (TO) and an upper toe-side edge portion of the front surface (FF) outside said toe-side edge (4TO).

6. The iron-type golf club head according to claim 4 or 5, wherein in the front view of the golf club head under a measuring state, the maximum height H of the main body, the lowest height h1 of the rear component (5) appearing on the toe-side, and the lowest height h2 of the rear component (5) appearing on the heel-side satisfy the following conditional expressions:

$$0.2=<h1/H=<0.8, \text{ and}$$

$$0.2=<h2/H=<0.6.$$

7. The iron-type golf club head according to claim 4 or 5, wherein in the front view of the golf club head under a measuring state, the maximum height H of the main body, the lowest height h1 of the rear component (5) appearing on the toe-side, and the lowest height h2 of the rear component (5) appearing on the heel-side satisfy the following conditional expressions: 0.2=<h1/H=<0.8 and 0.2=<h2/H=<0.6, and in the rear view of the golf club head under the measuring state, the lowest height A1 of the rear component (5) appearing on the heel-side, the lowest height A3 of the rear component (5) appearing on the toe-side, and the lowest height A2 of the rear component (5) appearing in a central portion of the head satisfy the following conditional expression: A1>A2<A3.

8. The iron-type golf club head according to claim 5, wherein said toe-side component (6) comprises a main part (6*a*) disposed backward of the front component (4), and a lower toe-side flange (6*b*) protruding forward from the main part (6*a*) so as to form a lower part of said toe surface (TO) and a lower toe-side edge portion of the front surface (FF) outside said toe-side edge (4TO).

9. The iron-type golf club head according to claim 2, wherein the front component (4) has an upper edge (4TP) positioned within the front surface (FF), and a toe-side edge (4TO) positioned within the front surface (FF), and the rear component (5) comprises a backside plate (5*a*) extending along a back surface of the front component (4), a top-side flange (8) protruding forward from the backside plate (5*a*) so as to form the top surface (TP) and an upper edge portion of the front surface (FF) above said upper edge (4TP), and an upper toe-side flange (9) protruding forward from the backside plate (5*a*) so as to form an upper part of said toe surface (TO) and an upper toe-side edge portion of the front surface (FF) outside said toe-side edge (4TO).

10. The iron-type golf club head according to claim 9, wherein said toe-side component (6) comprises a main part (6*a*) disposed backward of the front component (4), and a lower toe-side flange (6*b*) protruding forward from the main part (6*a*) so as to form a lower part of said toe surface (TO) and a lower toe-side edge portion of the front surface (FF) outside said toe-side edge (4TO).

* * * * *